US006910916B2

(12) United States Patent
Murakami

(10) Patent No.: US 6,910,916 B2
(45) Date of Patent: Jun. 28, 2005

(54) CONNECTOR

(75) Inventor: Takao Murakami, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/680,140

(22) Filed: Oct. 8, 2003

(65) Prior Publication Data

US 2004/0072465 A1 Apr. 15, 2004

(30) Foreign Application Priority Data

Oct. 9, 2002 (JP) ..... P2002-296507

(51) Int. Cl.[7] ..... H01R 13/60
(52) U.S. Cl. ..... 439/532; 439/378; 439/1
(58) Field of Search ..... 439/94, 527, 532, 439/716, 726, 378

(56) References Cited

U.S. PATENT DOCUMENTS 4,376,565 A * 3/1983 Bird et al. ..... 439/681
5,125,850 A * 6/1992 Locati ..... 439/404
6,193,541 B1 * 2/2001 Lee ..... 439/405

FOREIGN PATENT DOCUMENTS

| | | |
|---|---|---|
| JP | 10-241790 | 9/1998 |
| JP | 2001-283966 | 10/2001 |
| JP | 2002-198127 | 7/2002 |

OTHER PUBLICATIONS

Japanese Abstract No. 2002198127, dated Jul. 12, 2002.

* cited by examiner

*Primary Examiner*—Ross Gushi
*Assistant Examiner*—James R. Harvey
(74) *Attorney, Agent, or Firm*—Sughrue Mion, PLLC

(57) ABSTRACT

A first connector housing is provided with a first guide member extending in a first direction. A second connector housing is adapted to be fitted with the first connector housing in the first direction. The second connector housing is provided with a second guide member extending in the first direction. The first guide member and the second guide member are so configured as to guide a fitting operation of the first connector housing and the second connector housing while being brought into points or line contact with each other.

5 Claims, 5 Drawing Sheets

CONNECTOR

BACKGROUND OF THE INVENTION

This invention relates to a connector in which a pair of connector housings are fitted together while their fitting operation is guided, and the two connectors are electrically connected together.

FIGS. 5 and 6 show one a related-art connector disclosed in, for example, Japanese Patent Publication No. 2002-198127A (see the descriptions in pages 3 and 4, and FIGS. 5 and 6).

The connector 50 comprises female and male connector housings 51 and 55 which can be fitted together. The female connector housing 51 includes a peripheral wall 52 of a substantially square tubular shape formed integrally with an equipment, and male terminals 54 project into the interior of the peripheral wall 52. A locking projection 53 is formed on and projects upwardly from an upper surface of the peripheral wall 52, and is disposed substantially at a widthwise-central portion of this upper surface. A locking arm 58 on the male connector housing 55 is retainingly engageable with the locking projection 53.

A pair of upwardly-projecting guide ribs 60 are formed on the peripheral wall 52, and are disposed at opposite sides of the locking projection 53, respectively, the guide ribs 60 extending in a forward-rearward direction (i.e., the fitting direction) over an entire length of the peripheral wall 52. Also, a pair of guide ribs 61 are formed respectively on opposite side surfaces of the peripheral wall 52.

The male connector housing 55 includes a terminal receiving portion 56 for receiving female terminals 59, and a tubular portion 57 integrally connected to this terminal receiving portion 56 in surrounding relation thereto. The peripheral wall 52 can be fitted into a space between the terminal receiving portion 56 and the tubular portion 57.

The locking arm 58 is formed on a widthwise-central portion of an upper portion of the tubular portion 57. A locking hole 58*a* is formed through the locking arm. 58 in a direction perpendicular to the fitting direction, and the locking projection 53 on the female connector housing 51 is retainingly engageable in the locking hole 58*a*.

Recessed portions 62, corresponding respectively to the guide ribs 60, are formed at opposite sides of the locking arm 58, respectively. As the two connector housings 51 and 55 are fitted together, the guide ribs 60 are inserted into the recessed portions 62, respectively. Protruded portions 64, each having a guide groove 63 therein, are formed at opposite side portions of the tubular portion 57, respectively. The pair of guide ribs 61, formed respectively on the opposite side surfaces of the peripheral wall 52, can be inserted into the guide grooves 63, respectively.

When the male connector housing 55 is fitted into the female connector housing 51, the peripheral wall 52 is inserted into the space between the tubular portion 57 and the terminal receiving portion 56, and the guide ribs 60 are inserted respectively into the recessed portions 62, and the guide ribs 61 are inserted respectively into the guide grooves 63, so that the fitting operation of the two connector housings 51 and 55 is carried out.

However, the above connector 50 has the following problems to be solved.

The fitting operation of the two connector housings 51 and 55 are carried out while the guide ribs 60 and 61, formed respectively at the four portions of the peripheral wall 52, are held in face-contact with the recessed portions 62 and guide groove portions 63 (which are formed at the tubular portion 57), respectively. Therefore, there is encountered a problem that the sliding resistance increases, so that the fitting operation can not be effected smoothly.

When the two connector housings 51 and 55 are fitted together, the sliding resistance due to the sliding contact between the male terminals 54 and the female terminals 59 is added to the sliding resistance due to the sliding contact between the guide ribs 60 and the recessed portions 62, and the sliding resistance due to the sliding contact between the guide ribs 61 and the guide groove portions 63. Therefore, the total sliding resistance becomes large. Particularly in the case of the multi-pole connector, the sliding resistance, produced by the terminals 54 and 59, becomes large, and the efficiency of the fitting operation is lowered. When the sliding resistance increases, so that the efficiency of the fitting operation is lowered, the automation of a connector-assembling line can not be achieved.

Therefore, in order to reduce the sliding resistance between each guide rib 60 and the corresponding recessed portion 62 and to reduce the sliding resistance between each guide rib 61 and the corresponding guide groove portion 63, it may be proposed to provide a clearance or gap between the sliding surfaces of each guide rib and the corresponding portion. However, when such clearances are provided, the two connector housings 51 and 55 shake relative to each other during the fitting operation, so that the guiding performance is adversely affected. As a result, in some cases, the male terminal 54 strikes against the female terminal 59, and a tab-like electrical contact portion of the male terminal 54 is bent, and a box-like electrical contact portion of the female terminal 59 is deformed.

In the case where the connector 50 is used in an engine room of an automobile, a household electrical appliance (in which vibrations occur) or others, external vibrations are transmitted to the connector 50, thereby inviting a problem that the two terminals 54 and 59 rub each other, and are subjected to the frictional wear or corrosion.

SUMMARY OF THE INVENTION

It is an object of the invention to provide a connector in which a sliding resistance, developing between each guide rib and a corresponding guide groove, is reduced so as to enable a smooth fitting operation, thereby enhancing the efficiency of the fitting operation.

In order to achieve the above object, according to the invention, there is provided a connector, comprising:

a first connector housing, comprising a first guide member extending in a first direction; and a second connector housing, adapted to be fitted with the first connector housing in the first direction, the second connector housing comprising a second guide member extending in the first direction, wherein the first guide member and the second guide member are so configured as to guide a fitting operation of the first connector housing and the second connector housing while being brought into points or line contact with each other.

In the above configuration, the pair of connector housings are positioned relative to each other in a direction perpendicular to the first direction, while the fitting operation of the two connector housings is guided. Therefore, the pair of connector housings are prevented from shaking relative to each other, and the erroneous insertion of terminals are prevented, and the mating terminals are positively electrically connected together.

The guide members, which cooperate with each other to guide the fitting operation, are brought into points or line contact with each other. Therefore, the sliding resistance, developing between the guide members during the fitting operation, is reduced, and the pair of connector housings are fitted together with a lower fitting force.

Preferably, the first guide member is a rib member and the second guide member is a groove into which the rib member is inserted while being guided.

In this case, there can be provided the low-fitting-force connector with a simple structure.

Here, it is preferable that one of the rib member and the groove is formed with protrusions, and the other one of the rib member and the groove is formed with flat faces on which the protrusions are slid when the fitting operation is performed.

In this case, the points or line contact of the guide members are realized by the projections and the flat faces to reduce the sliding resistance.

Here, it is further preferable that the protrusions are formed on the rib member, and a proximal portion of each of the protrusions is narrowed.

In this case, since the narrowed proximal portion of the rib member will not interfere with edges of the groove, the fitting operation of the pair of connector housings is carried out smoothly.

It is also preferable that the protrusions are arranged in the first direction. According to the points contact between the protrusions and the flat faces, the sliding resistance can be reduced remarkably.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the present invention will now be described in detail with reference to the accompanying drawings.

Figure 1:
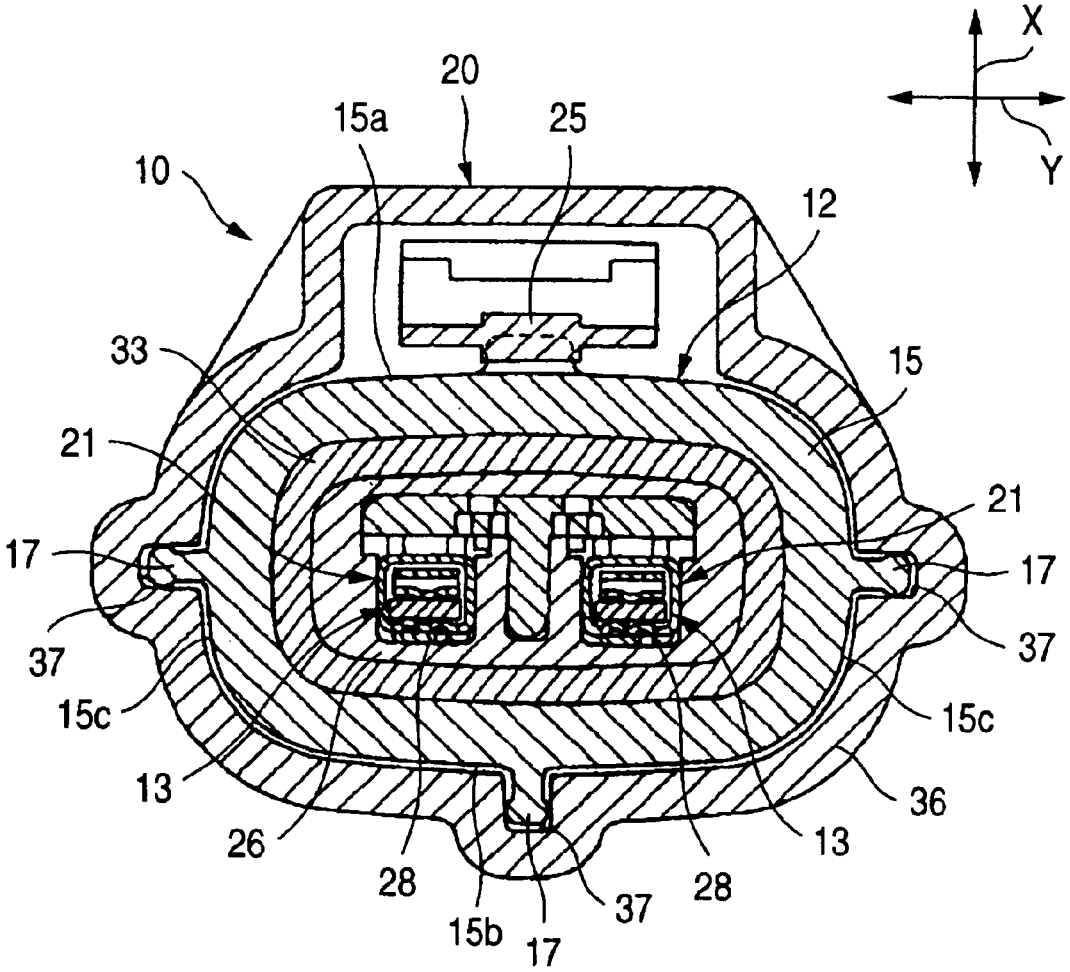
FIG. 1 is a transverse cross-section view of a connector according to one embodiment of the invention, showing an assembled condition.
Figure 2:
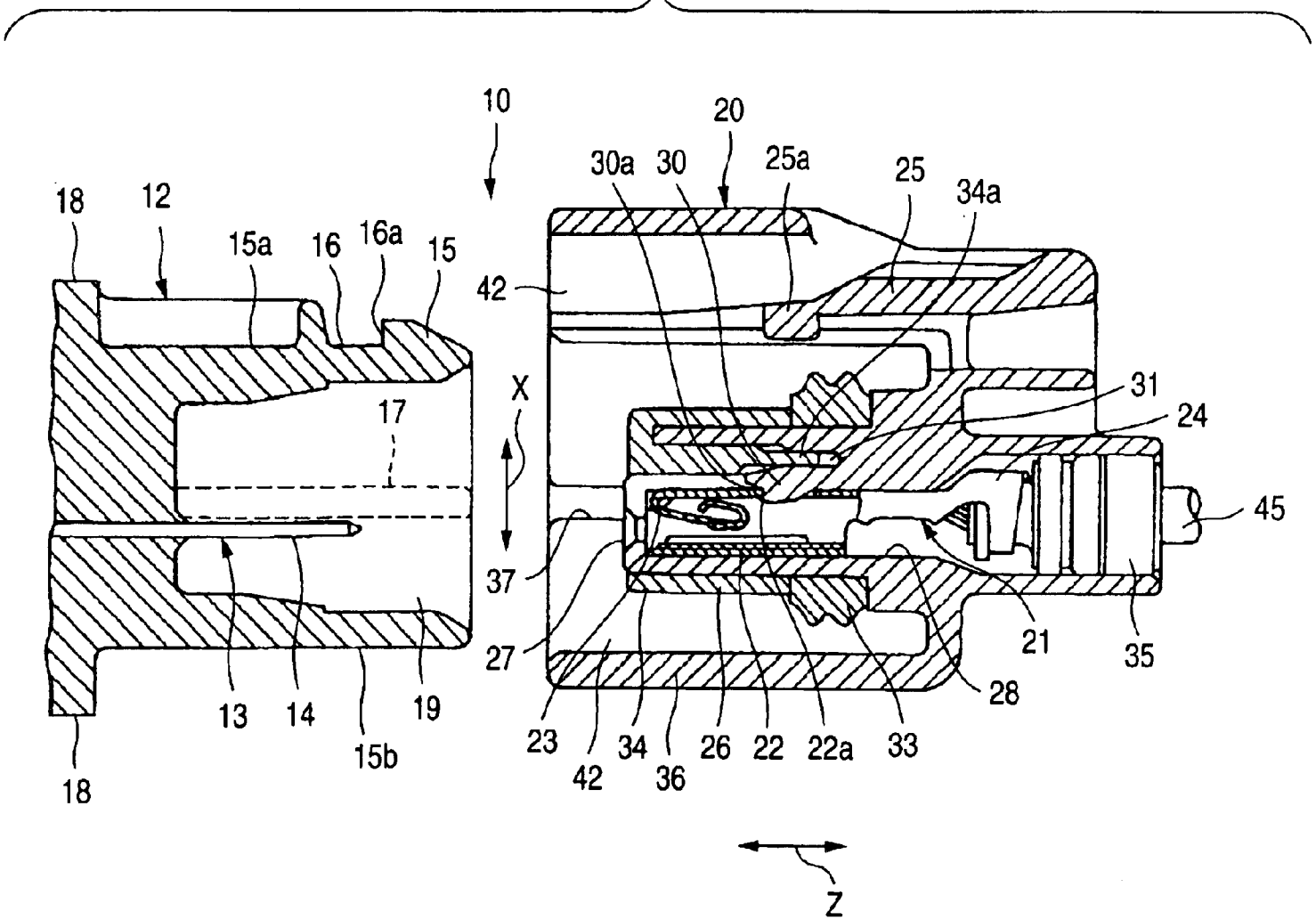
FIG. 2 is an exploded, longitudinal cross-section view of the connector of FIG. 1.

As shown in FIGS. 1 and 2, a connector 10 according to one embodiment of the invention comprises a female connector housing 12, and a male connector housing 20. Guide ribs 17 and guide grooves 37 linearly guide the fitting operation of the pair of connector housings 12 and 20, and a feature of this connector 10 resides in the fact that each guide rib 17 and the corresponding guide groove 37 contact each other at a plurality of points or a plurality of lines.

In this specification, the connector housing in which male terminals 13 are received is defined as the female connector housing 12, and the connector housing in which female terminals 21 are received is defined as the male connector housing 20. Each of the pair of connector housings 12 and 20 is injection molded into an integral construction, using a synthetic resin material.

The female connector housing 12 is the equipment-side connector housing which is mounted directly on an on-vehicle equipment of an automobile, and is disposed in a waiting condition. This female connector housing 12 has a connector fitting chamber 19 (for receiving an inner housing 26 of the male connector housing 20 therein) formed inside an annular peripheral wall (wall portion) 15.

The male terminals 13 are so disposed as to be opposed respectively to terminal passage holes 27 in the male connector housing 20, and project into the interior of the connector fitting chamber 19, and extend forwardly in a fitting direction. When the pair of connector housings 12 and 20 are fitted together, a tab-like electrical contact portion 14 of each male terminal 13, while guided by the terminal passage hole 27, is inserted into an electrical contact portion 22 of the corresponding female terminal 21.

An engagement groove 16 for retaining engagement with a locking arm 25 of the male connector housing 20 is formed in an upper wall 15*a* of the peripheral wall 15, and is disposed at a substantial widthwise center of the upper wall 15*a*. A vertical retaining surface 16*a* is formed at the front side of the retaining groove 16, and a distal end portion 25*a* of the locking arm 25 is retained by this retaining surface 16, thereby holding the pair of fitted connector housings 12 and 20 against withdrawal.

As shown in FIG. 1, the outwardly-projecting guide ribs 17 are formed respectively on opposite side walls 15*c* and lower wall 15*b* of the peripheral wall 15, and extend in the fitting direction. The guide ribs 17 are thus formed at the three portions, respectively, and when these guide ribs 17 are engaged respectively in the guide grooves 37 in the male connector housing 20, the male connector housing 20 (which is fitted into the female connector housing) is positioned in two perpendicularly-intersecting directions in a plane perpendicular to the fitting direction. The number of the guide ribs 17 is arbitrary, and can be two or more than three.

Namely, the positioning in an upward-downward direction X is effected by the pair of guide ribs 17 formed respectively on the opposite side walls 15*c*, and the positioning in a right-left direction Y is effected by the guide rib 17 formed on the lower wall 15*b*. Although any guide rib is not formed on the upper wall 15*a*, guide ribs can be formed at the opposite sides of the engagement groove 16, respectively.

Figure 3A:
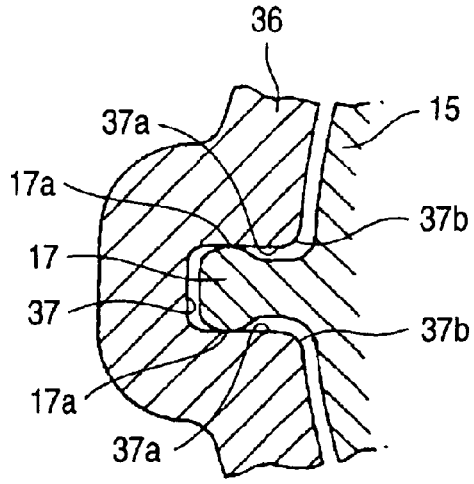
FIG. 3A is an enlarged transverse section view of a guide rib and a guide groove in the connector of FIG. 1.

As shown in FIG. 3A, the guide rib 17 is thinned (reduced in thickness) at its proximal portion (which is integrally connected to the side wall 15*c*.) so that the guide rib 17 will not interfere with opposed corner portions 37*b* of the guide groove 37. A gap is formed between each corner portion 37*b* and the proximal portion, so that the guide rib 17 can be smoothly inserted into the guide groove 37. The guide rib includes protrusions on side surfaces 17*a* which project from the thinned portion.

According to the above configuration, the connector fitting operation is carried out, with the side surfaces of the distal end portion of the guide rib 17 held in line-contact respectively with opposed groove surfaces (sliding surfaces) 37*a* of the guide groove 37.

Figure 3B:
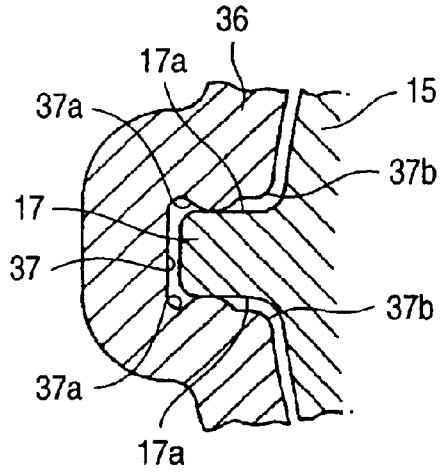
FIG. 3B is an enlarged transverse section view of a modified example of the guide rib and the guide groove.

FIG. 3B shows a modified example of the guide rib 17 and the guide groove 37. In this case, each of opposed groove surfaces 37*a* of the guide groove 37 is formed into a convexly-curved surface (i.e., a protrusion), while each of opposite side surfaces 17*a* of the guide rib 17 is formed into a flat surface. The connector fitting operation is carried out, with the guide rib 17 held in line-contact with the guide groove 37. In this modified example, the proximal portion of the guide rib 17 is kept thick, so that there is an advantage that the strength of the guide rib 17 increases.

The guide rib 17 and the guide groove 37 are thus held in line-contact with each other, and therefore a sliding resistance, developing between the guide rib 17 and the guide groove 37 during the connector fitting operation is reduced, and the pair of connector housings 12 and 20 are fitted together with a lower fitting force, and the connector fitting operation is carried out smoothly, so that the efficiency of the fitting operation is enhanced.

With the simple improvement in which one of the guide rib 17 and the guide groove 37 is changed in shape, the low-insertion-force connector 10 can be obtained.

Figure 4A:
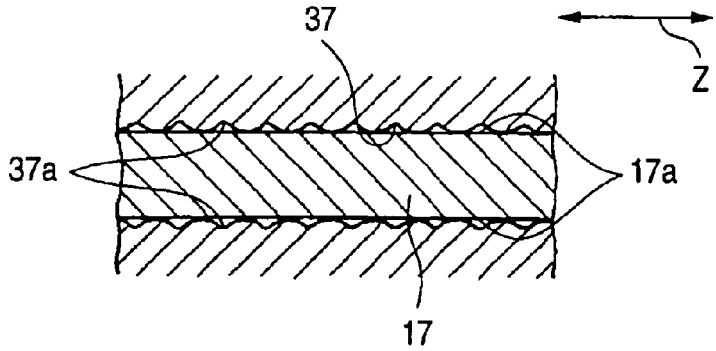
FIG. 4A is an enlarged longitudinal section view of the guide rib and the guide groove in the connector of FIG. 1.
Figure 4B:
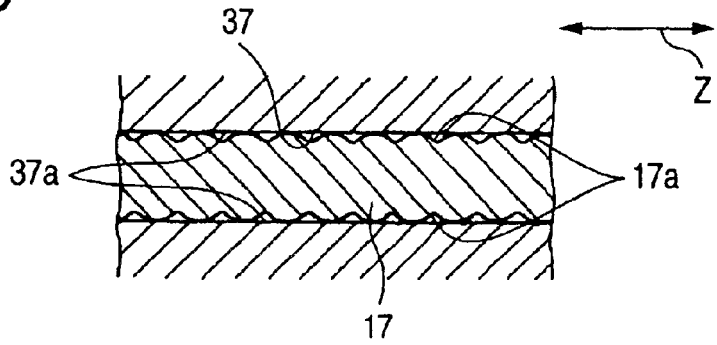
FIG. 4B is an enlarged longitudinal section view of the modified example of the guide rib and the guide groove.
Figure 5:
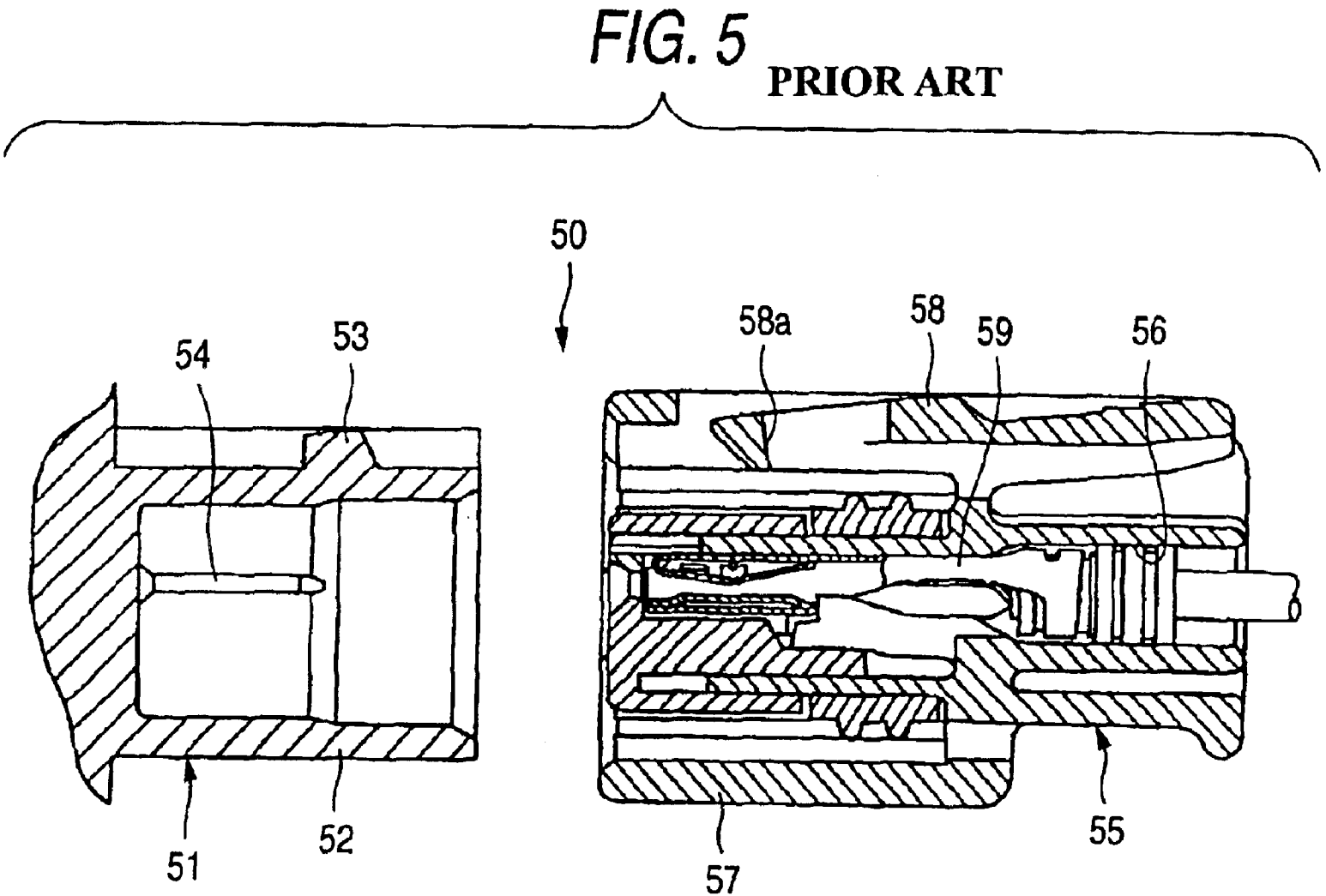
FIG. 5 PRIOR ART
FIG. 5 is an exploded, longitudinal cross-section view of a related-art connector.
Figure 6:
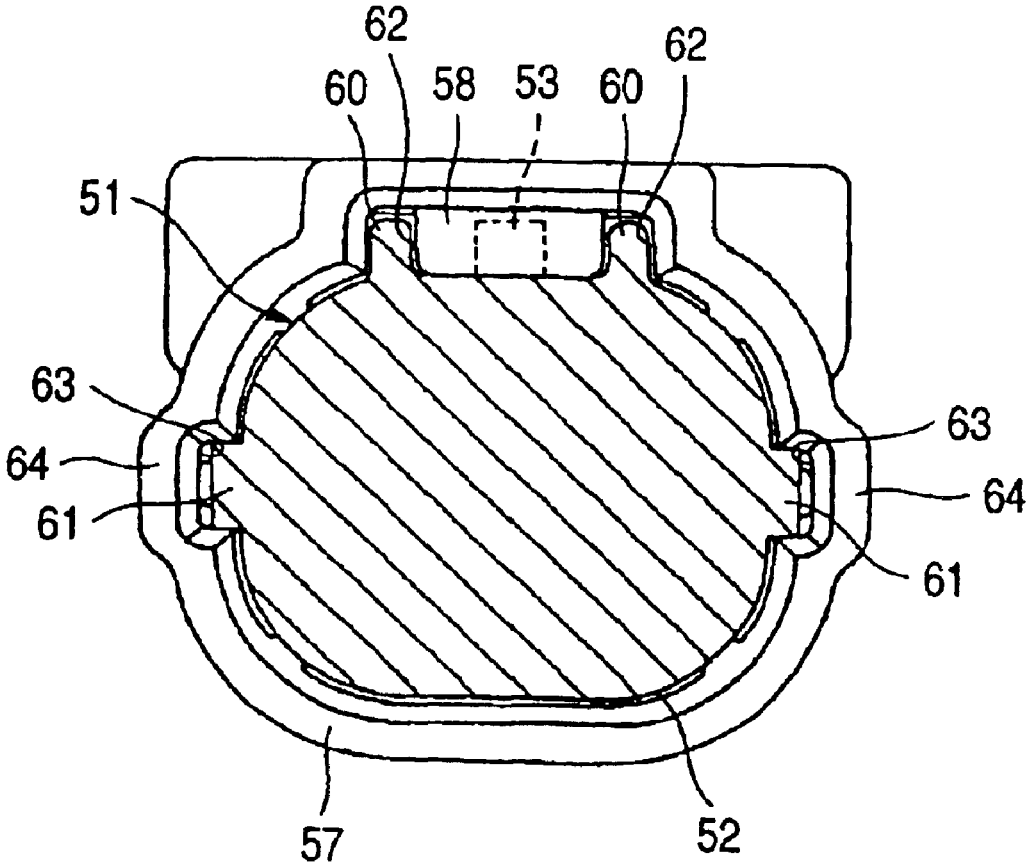
FIG. 6 PRIOR ART
FIG. 6 is a transverse cross-section view of the related-art connector, showing an assembled condition.

Another feature of the present invention resides in that each of the sliding surfaces (i.e., the opposite side surfaces 17*a* or the opposed groove surfaces 37*a*) of one of the guide rib 17 and the guide groove 37 is formed into a corrugated surface extending in the fitting direction Z, while each of the sliding surfaces of the other is formed into a flat surface as shown in FIGS. 4A and 4B.

FIG. 4A shows one example in which the groove surfaces 37*a* of the guide groove 37 are corrugated. FIG. 4B shows another example in which the side surfaces 17*a* of the guide rib 17 are corrugated. Thus, the sliding surfaces of one of the guide rib and the guide groove are made corrugated, so that the guide rib 17 and the guide groove 37 contact each other at discrete points, and the areas of contact between the two are made smaller as compared with the case where the guide rib and the guide groove contact each other at surfaces or lines. Therefore, the sliding resistance can be markedly reduced.

The male connector housing 20 is the harness-side connector housing connected to wires 45, and is fitted into the female connector housing 12 disposed in a waiting condition.

The male connector housing 20 includes the tubular inner housing 26, and the outer housing 36 surrounding the inner housing 26. The inner housing 26 has terminal receiving chambers 28 formed therein, and the female terminals 21, connected respectively to end portions of the wires 45, are received in these terminal receiving chambers 28, respectively.

The female terminal 21 is formed by blanking a piece from an electrically-conductive sheet and then by bending this piece. The female terminal 21 includes the electrical contact portion 22 formed at one end thereof, and a wire connection portion 24 formed at the other end thereof. The electrical contact portion 22 has a box-like shape, and a resilient contact piece portion 23 of a curved shape for contact with the male terminal 13 is provided within this electrical contact portion 22. The wire 45 passing through a waterproof rubber plug 35 is clamped by the wire connection portion 24.

The rubber plug 35 is a bellows tube, and is held in intimate contact with an inner surface of the terminal receiving chamber 28. With this construction, water drops, moving along the wire 45, are prevented from intruding into the terminal receiving chamber 28.

A housing lance 30 is formed on a lengthwise-central portion of the upper surface of each terminal receiving chamber 28, and projects forwardly therefrom. A retaining surface 30*a* is formed at a distal end of the housing lance 30. This retaining surface 30*a* abuts against a retaining portion 22*a*, formed at the electrical contact portion 22 of the female terminal 21 inserted in the terminal receiving chamber 28, thereby retaining the female terminal 21.

A flexure space 31 for the housing lance 30 is formed at the upper side of the housing lance 30. The housing lance 21 is pushed upwardly by the female terminal 21, thereby allowing the insertion of the female terminal 21. When a projecting portion 34*a* of a front holder 34, attached to a front end portion of the inner housing 26, is inserted into the flexure space 31, this projecting portion 34*a* prevents the elastic deformation of the housing lance 30, thereby preventing the rearward withdrawal of the female terminal 21.

A waterproof ring 33 is fitted on an inner rear end portion of the inner housing 26, and this waterproof ring 33 is held in intimate contact with the inner peripheral surface of the peripheral wall 15 to form a waterproof seal between the pair of connector housings 12 and 20.

The outer housing 36 has a substantially square tubular shape, and is integrally connected to the rear end portion of the inner housing 26, and extends in the fitting direction Z. The front end of the outer housing 36 projects forwardly beyond the front end of the inner housing 26 in the fitting direction Z so as to be opposed to a flange portion 18 of the female connector housing 12.

The guide grooves 37, corresponding respectively to the guide ribs 17 formed respectively at the three portions of the peripheral wall 15 of the female connector housing 12, are formed in the inner surface of the outer housing 36. The guide ribs 17 are engaged respectively in the guide grooves 37 so that the connector fitting operation can be carried out smoothly.

An annular fitting space 42 is formed between the inner housing 26 and the outer housing 36, and the female connector housing 12 is fitted into this fitting space 42. The peripheral wall 15 of the female connector housing 12 closely fits in this fitting space 42.

For assembling the connector 10, the male connector housing 20 is opposed to the female connector housing 12, and then the pair of connector housings 12 and 20 are moved toward each other, and the guide ribs 17 are engaged in the guide grooves 37, respectively, and the peripheral wall 15 is pushed into the annular fitting space 42, thereby assembling the connector. The sliding resistance, developing between each guide rib 17 and the corresponding guide groove 37, is small, and therefore the pair of connector housings 12 and 20 are fitted together with a lower fitting force.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A connector, comprising:

a first connector housing, comprising a first guide member extending in a first direction; and a second connector housing, adapted to be fitted with the first connector housing in the first direction, the second connector housing comprising a second guide member extending in the first direction, wherein the first guide member and the second guide member are so configured to contact each other along at least one of a plurality of points and a line when the first and second connector housings are brought together.

2. The connector as set forth in claim 1, wherein the first guide member is a rib member and the second guide member is a groove into which the rib member is inserted while being guided.

3. The connector as set forth in claim 2, wherein one of the rib member and the groove is formed with protrusions, and the other one of the rib member and the groove is formed with flat faces on which the protrusions are slid when the fitting operation is performed.

4. The connector as set forth in claim 3, wherein the protrusions are formed on the rib member, and a proximal portion of each of the protrusions is narrowed.

5. The connector as set forth in claim 3, wherein the protrusions are arranged in the first direction.

* * * * *